US005322723A

United States Patent [19]

Bickett

[11] Patent Number: 5,322,723

[45] Date of Patent: Jun. 21, 1994

[54] TAMPERPROOF TRANSPARENCY MOUNT WITH TEAR STRIP

[76] Inventor: Earl H. Bickett, 7314 W. 90th St., Bridgeview, Ill. 60455

[21] Appl. No.: 103,102

[22] Filed: Aug. 9, 1993

[51] Int. Cl.[5] ..... G03C 3/00

[52] U.S. Cl. ..... 428/43; 430/10; 430/12; 40/361; 428/916

[58] Field of Search ..... 428/43, 916; 430/10, 430/12, 496; 40/361, 362

[56] References Cited

U.S. PATENT DOCUMENTS 2,842,882 7/1958 Greene et al. ..... 40/361 X
3,336,690 8/1967 Walter et al. ..... 40/361 X
3,949,501 4/1976 Andrews et al. ..... 430/10 X
4,592,976 6/1986 Whitehead ..... 430/10
4,692,394 9/1987 Drexler ..... 430/12 X
4,868,027 9/1989 Hunkeler et al. ..... 428/43 X
4,902,142 2/1990 Lammert et al. ..... 428/43 X

*Primary Examiner*—Daniel Zirker
*Attorney, Agent, or Firm*—Cornelius J. Husar

[57] ABSTRACT

The disclosure relates to a tamper-proof transparency mount which includes a zipper tab permitting easy access and removal of the transparency from its mount when sealed without doing any damage to the transparency under authorized conditions. Several embodiments are disclosed which provide different locations as well as different style tabs. The transparency mount provides an indication of unauthorized entry and also easy access for authorized entry to the transparency.

19 Claims, 2 Drawing Sheets

TAMPERPROOF TRANSPARENCY MOUNT WITH TEAR STRIP

BACKGROUND OF INVENTION

The subject application relates to transparency mounts and more specifically, it relates to a commercial photography mount for the stock photography market.

Historically, commercial photographers have used commercially available mounts for presentation of their work in portfolios and for presentation of their selected best shots to clients who have given them photographic shooting assignments. "Large size" or "portfolio size" products are loosely defined as products having a finished outside dimension of eight inches by ten inches or eleven inches by fourteen inches and any one of many possible inside single or multiple windows commonly referred to as the "image area". A traditional method of obtaining a photograph of a "girl in bikini" or "woman in a business suit" for use in a print ad, brochure or billboard is to give a commercial photographer a shooting assignment. As is known in the industry, these assignments can be "location" or "studio" shoots. Depending on the assignment, the location photographer alone or travelling with an entourage of assistants, art/-creative director(s), model(s), prop people, etc. travel across town or around the world to do the shoot.

Studio photography can also be very involved. Assignments may require the services of some or all of the types mentioned above. In addition, either may need the support of some very expensive equipment such as cranes, helicopters, fire control and the like.

It can readily be seen from the above discussion that both studio photography and location photography can be very, very expensive.

The aforementioned type of commercial photography and its associated expense has served as a catalyst for the "stock photography house". A stock photography house serves as a photography library. The larger stock photography houses maintain "in stock" thousands and in some cases, millions of photographs. With the entry of stock photography houses on the commercial photography scene, a publisher of a magazine needing a photograph of a girl in a bikini on Waikiki beach with only palm trees and Diamond Head in the background need only call the stock photography house and state their requirements.

The stock photography house will research their files and send the publisher several dozen different photographs which will meet the requirements of the publisher. The publisher will then select the particular photograph or photographs which he will use. The main advantage stock photography houses offer is price. The photographs which they supply to the publisher or any other client are rented for a particular usage, i.e. for a particular number of pieces that will be printed or posted on billboards, for a certain period of time of a particular ad campaign. The cost of "renting" these photographs can be as low as $150.00 per image, i.e. shots, photos, transparencies, pictures, and up to tens of thousands of dollars for a particularly excellent image or one used in an extensive print run or ad campaign. Compared to the cost of assignment or studio photography, this can prove to be a real bargain as well being much faster.

For the purposes of providing a complete background in the instant application, it is important to know that the photographs in a stock house are usually kept and presented in a "transparency" form. A 35 mm slide is an example of a common transparency. It is transparent and by holding it up to the light, one can see the images thereon. In addition, it is a film positive, that when projected, held to the light or laid on a light box, it shows a "right reading" image, i.e. not a "wrong reading" image as in a film negative where the light images are dark and the dark images are light.

When a transparency leaves a stock house, the images are packed in a variety of ways depending upon the procedures and policies of the particular stock house. The most common packaging is as follows:

(1) The transparency is placed into a clear plastic sleeve (such as acetate) to protect it from scratches and dust since the transparency is a film material and is quite fragile. Frequently, the lab that develops the film will place the transparency in such a sleeve when it is returned after developing.

(2) The transparency while in the clear plastic sleeve, is then positioned in the window and affixed to the inside of a transparency mount with tape. Transparency mounts are normally made of a paper stock. The mount is then closed and usually sealed with some type of adhesive seal that prevents the removal of the transparency without the seal being broken. These seals often carry warnings to the effect that, "if this seal is broken, you've bought the rental price of the image".

Once the package is received by the client, the images are examined and hopefully one or more will be suitable for the project at hand. The client then contacts the stock house, a price is negotiated, an agreement struck and permission is given to the client to reproduce the image or images in accordance with the terms of the agreement.

At this time, the paper transparency mount is opened by the client, removed from the sleeve and reproduced for use in printing. The bought and unbought images are then returned to the stock house, refiled and stored for future use.

As one can readily recognize, the transparency must be removed from the mount and acetate sleeve to provide the greatest quality print. However, as a means of preventing the unauthorized removal of the transparency from its mount, i.e. the removal, printing and returning to the stock house without paying the required rental fee, some stock houses, photo labs and photographers have required their mount supplier to provide a mount which when sealed after the insertion of the transparency, will literally require the destruction of the mount which would require the client to pay for the mounts returned in the destructed condition.

SUMMARY OF THE INVENTION

While solving and overcoming the problem of "unauthorized" removal of a transparency from its mount through the use of improved mount sealing methods, another equally serious problem has been inserted into the stock house transparency rental industry. The problem that has been created is one that is associated with the "authorized use" of a particular image which was approved for rental by the stock house.

As indicated above, currently used transparency mounts are adhesively sealed on two or up to all four sides of the mount. The sealing means may take the form of double sided adhesive strips applied at the time of manufacturing of the mount blank or alternatively, adhesive which is applied by the user at the time of mounting the transparency therein. However, after the transparency is positioned in the window or viewing area, the sides are sealed to prevent the unauthorized removal from the mount. As mentioned above, current sealing requires the destruction of the mount to obtain access to the transparency for printing purposes. In the process of destroying the mount to remove the transparency, there is a great likelihood that damage will be done to the transparency, either by tearing, creasing or smudging of the print with finger prints.

It was with this knowledge in mind that applicant was motivated to develop the subject invention. As will be illustrated and discussed in greater detail hereinafter, applicant has developed a transparency mount that includes a quick release tab which provides ready access to the transparency allowing its removal without doing any damage to the transparency. There are illustrated and described several different embodiments directed to the location of the zipper tab such as an outer peripheral tab, front or rear tabs and window tabs or single or multiple zipper tabs. Each of the various embodiments will be discussed in greater detail below.

Each of the embodiments is incorporated into the manufacture of the blank mounts. After insertion of the transparency in the manner described above, simply lifting and pulling on the zipper tab removes some of the paper stock material from the mount thus providing easy and damage-free access to the enclosed transparency.

OBJECTS OF THE INVENTION

An object of the invention is to provide a tamperproof secure transparency mount which allows damage free access to the transparency.

Another object of the invention is to provide a transparency mount which provides an indication of unauthorized entry.

A further object of the invention is to provide a transparency mount that includes an access zipper tab which can be located at any one of several different locations.

These and other objects of the instant invention will become more apparent hereinafter. The instant invention will now be described.

DETAILED DESCRIPTION OF THE DRAWINGS

Figure 1:
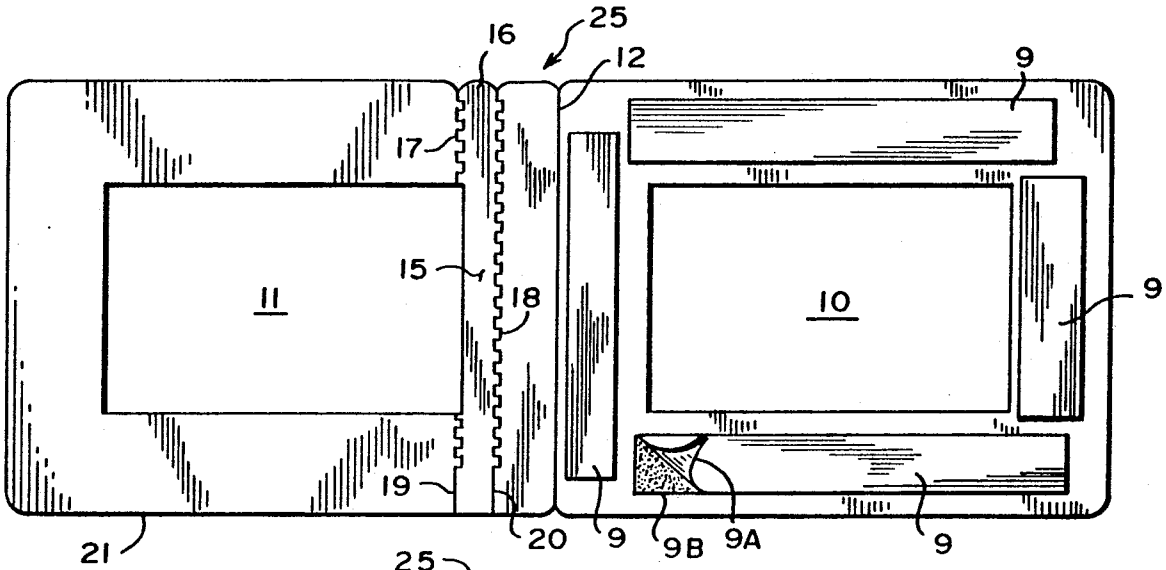
FIG. 1 is an illustration of a blank transparency mount in its unfolded and unsealed position with a single zipper tab.

Turning now to FIG. 1, there is illustrated a first embodiment of the novel transparency mount, indicated generally by reference numeral 25. In this view, transparency mount 25 is shown in its open blank form prior to insertion of a transparency and sealing about its four sides. A plurality of double sided adhesive strips 9 are shown, one strip 9 for each side. As shown, one of the strips 9 is adhered to mount 25 and has an upper peel-off strip 9A which is be partially pulled back to reveal the upper adhesive 9B on strip 9 which will come in contact with the opposite half of mount blank 25 when folded along fold line 12 to seal the transparency therein. Although only one peel-off strip is shown, all strips 9 are so provided. Transparency mount 25 is made of stock material with two viewing windows cut out and a fold line 12 impressed on the upper surface of transparency mount 25.

Positioning of viewing windows 10 and 11 is such that when the transparency is centrally located within the viewing window 10 or 11 and the remainder of transparency mount is folded back upon itself at fold line 12, the transparency mounted therein will usually be centrally located relative to the mount. As indicated above, in the background material, the peripheral edges are provided with adhesive at the time of manufacture of the blank mount or at the time of mounting the transparency by the user to provide a permanent seal of the transparency within mount 25. As also pointed out, removal or across to the transparency can only be accomplished through destruction of mount 25 within which it is mounted. Such destruction of mount 25 would also result in damage incurred by the transparency in the form or creases, tears, smudges or the like.

In order to overcome the above noted problems and to allow damage-free access to the transparency mounted therein, applicant has developed a novel zipper tab 15 which is pre-punched into the transparency mount 25 at the time of manufacture. Zipper tab 15 includes a start tab portion 16 and a pair of parallel saw-tooth lines 17 and 18 which allow the removal of zipper tab 15 from the remaining portion of transparency mount 25. As illustrated, a portion of saw-tooth line 17 runs along the edge of viewing window 11 and therefore, that portion of zipper tab 15 is a straight line with the saw-tooth configuration 17 reappearing at the lower horizontal intersecting line of viewing window 11. It is to be noted that the lowermost portions of saw-tooth lines 17 and 18 are straight indented portions without the saw-tooth. Once zipper tab 15 is peeled back to that location, removal along lines 19 and 20 continues to the lower edge 21 without any problem. Once zipper tab 15 is removed from transparency mount 25, access to and removal of the transparency is permitted without any undesired damage to the transparency therein.

Figure 2:
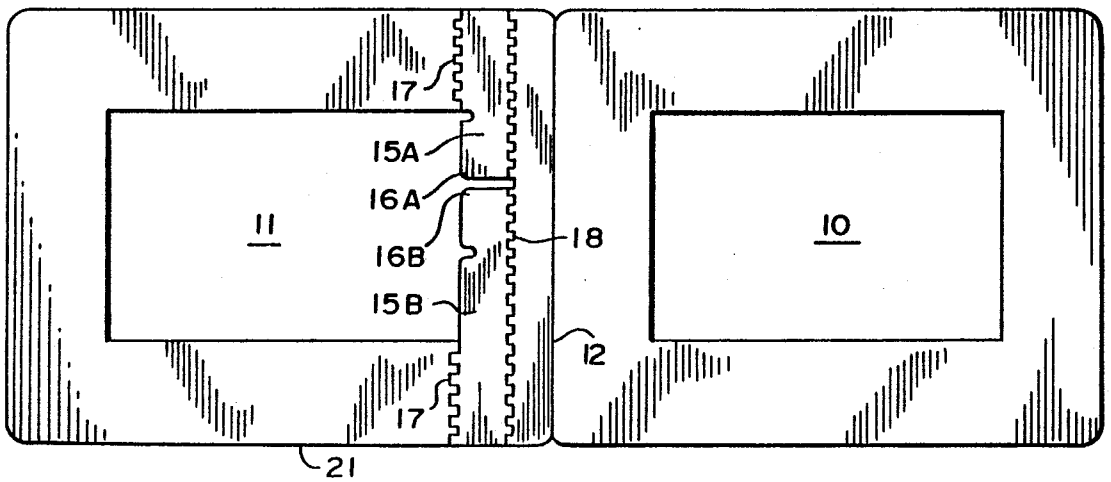
FIG. 2 is a second embodiment of a blank transparency mount in its unfolded and unsealed position illustrating a double zipper tab.

Referring now to FIG. 2, there is shown a second embodiment of the subject invention. Transparency mount 25 is illustrated in its blank form, similar to that of FIG. 1. However, in this embodiment there is shown a modification of the zipper tab 15. As can be seen from FIG. 2 zipper tab 15 comprises an upper portion 15A and a lower portion 15B. Both upper portion 15A and lower portion 15B are provided with pre-punched saw-tooth lines 17 and 18 on opposite sides of upper and lower zipper tab portions 15A and 15B. Upper zipper tab portion 15A is provided with a starting point 16A, whereas lower zipper tab portion 15B is provided with its own starting point 16B. Merely by inserting one's fingernail under either starting point 16A or 16B and raising it, followed by pulling on starting point 16A or 16B, upper and lower zipper tab portions 15A and 15B can easily be removed from transparency mount 25 thus providing damage free access to a transparency mounted therein. As in FIG. 1, the left edge of zipper tab portions 15A and 15B coincides with the right vertical edge of viewing window 11. Although FIG. 2 does not show adhesive strips 9, it is to be understood that either adhesive strips 9 or a form of adhesive is applied to the four sides after insertion of the transparency by the end user.

Figure 3:
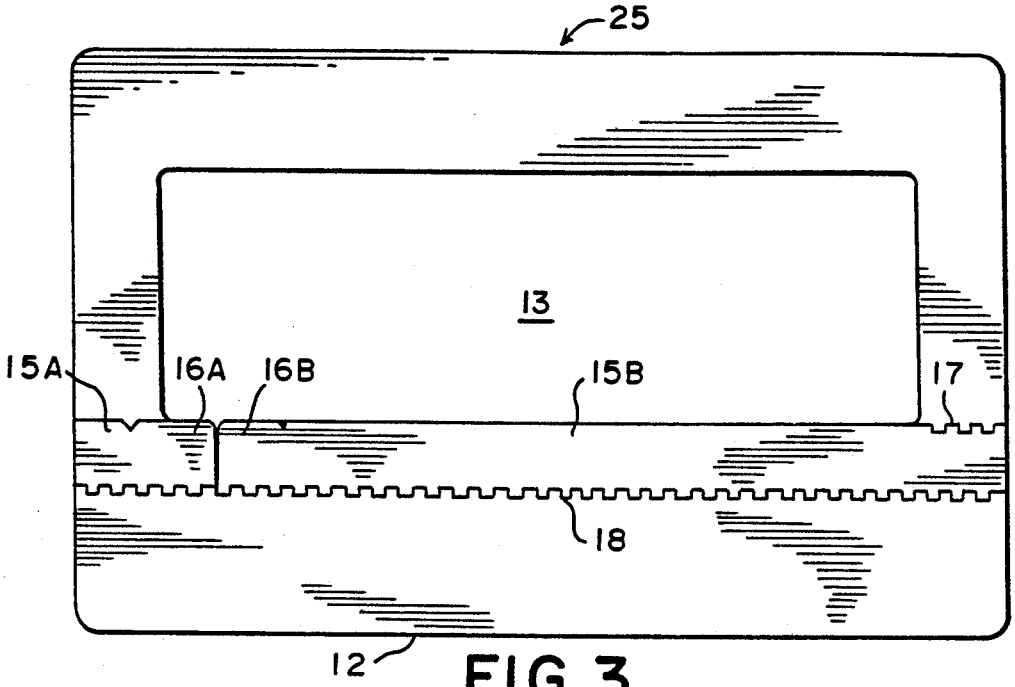
FIG. 3 is third embodiment of the novel transparency mount in its folded condition illustrating a double zipper tab.

Referring now to FIG. 3, there is illustrated a third embodiment of the invention. In this view, transparency mount 25 is illustrated in its closed condition, rather than its open blank form condition as illustrated in FIGS. 1 and 2 above. For purposes of explanation, it can be assumed that a transparency has been appropiately positioned within viewing window 13 and the sealing along all four has taken place.

FIG. 3 discloses a dual zipper tab having first and second zipper tab portion 15A and 15B with starting points 16A and 16B for easy removal. As in previous figures, saw-tooth lines 17 and 18 are pre-punched in mount 25 to allow easy removal of tab portions 15A and 15B. The basic difference between FIGS. 2 and 3 is their shape. The embodiment of FIG. 3 is designed to accommodate transparencies which are oblong as would be found in a panoramic transparency of a scenic view of a shore line, skyline or the like.

Figure 4:
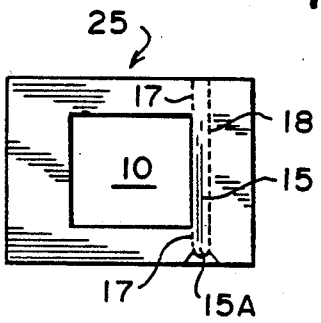
FIG. 4 is a fourth embodiment illustrating a single zipper tab along the window area.

FIG. 4 illustrates a transparency mount 25 in its sealed form with its transparency mounted therein. A single zipper tab 15 with its starting point 15A is positioned so as to coincide with the right vertical edge of viewing window 10. Simply by raising starting edge 15A and pulling upwardly thereon, zipper tab 15 can easily be removed along pre-punched tear lines 17 and 18. It is to be noted that the tear lines 17 and 18 are of a different configuration than in the previous FIGS. 1-3. In this embodiment, the tear lines 17 and 18 are formed by a series of closely spaced pre-punched dots which provide easy removal of zipper tab 15.

Figure 5:
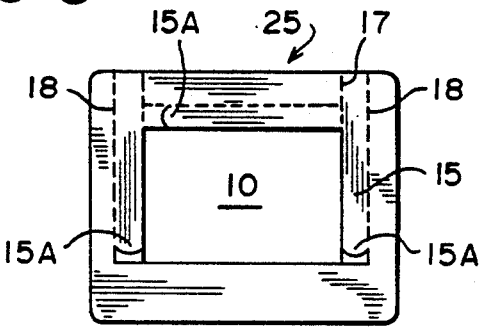
FIG. 5 is a fifth embodiment illustrating modified zipper tabs along the window area, demonstrating that more than one zipper tab can be used on a mount at a time.

FIG. 5 is a further embodiment wherein zipper tab 15 is provided with a starting point 15A which is located at the intersection of the lower horizontal edge and right vertical edge of viewing window 10. Tear lines 17 and 18 of zipper tab 15 are formed by a series of dash lines delineating the tear zone of zipper tab 15.

Figure 6:
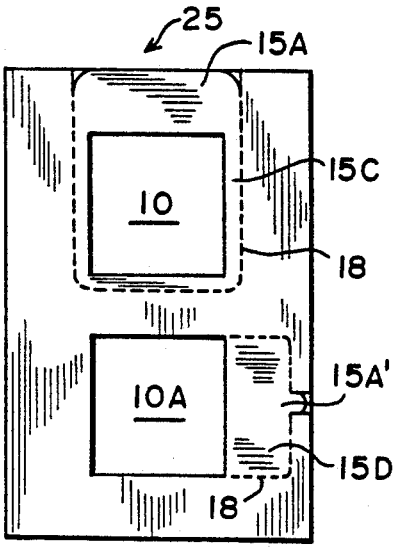
FIG. 6 is a sixth embodiment wherein two transparency windows are disclosed each with a different style zipper tab.

FIG. 6 is an illustration of an embodiment wherein a pair of viewing windows 10 and 10A are provided for receiving respective transparencies. Upper viewing window 10 is provided with its own zipper tab 15C and start point 15A while lower zipper tab 15D has its own start point 15A'. This type of mount could be used where the stock house photo-lab or photographer might want two images that are slightly different from each other thus enabling the client to make a comparison of the two images to aid in his selection.

Figure 7:
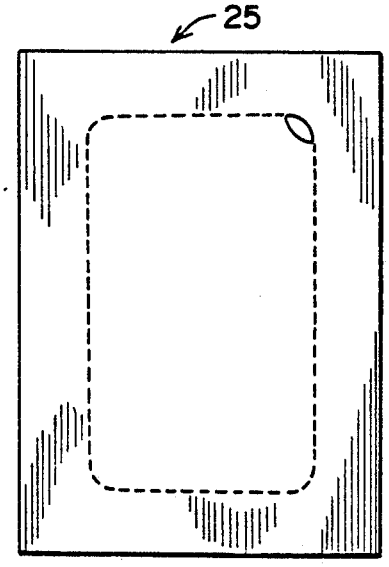
FIG. 7 is an illustration of a mount with a single zipper tab portion. This format allows the stock house or stock photographer to cut their own opening to fit the particular image that will be mounted therein.

FIG. 7 is an illustration of a mount with a single enlarged zipper tab portion. This format mount is a type which allows the stock house or stock photographer to cut or "crop-out" their own opening to fit the particular transparency that will be mounted therein.

In summary, it can be seen that applicant has provided a plurality of transparency mounts which include a secure means of presenting transparencies to a client for viewing and subsequent rental purposes which will allow the client ready access and damage-free removal of the transparency after a selection is made. Although all the views illustrate the zipper tab 15 as being located on the rear of the mount along an inside edge of the viewing window, other locations may be utilized. Further, the style of tear line, i.e. saw-tooth, dotted perforations, dashed perforations, are only a few of the many variations which can be utilized. The common denominator which is present in all the embodiments illustrated, is a tamper-proof transparency mount and a zipper tab which can readily be removed from the transparency mount without damaging the transparency mounted therein.

While the invention has been described in its preferred embodiments, it is to be understood that the words which have been used are words of description rather than limitation and that changes may be made within the purview of the appended claims without departing from the full scope or spirit of the invention.

Having thus described my invention, I claim:

1. A transparency mount comprising a pre-formed blank; said preformed blank having a rectangular configuration and a centrally located fold line dividing said preformed blank into two equal sized portions when folded along said fold line;

said preformed blank further including at least a pair of image viewing windows which become superimposed upon folding said preformed blank along said fold line; peripheral adhesive means for sealing a protected transparency therein; removable tabs means formed in one of said portions for allowing ready access to a protected transparency which has been mounted in said superimposed viewing window and subsequently sealed to prevent unauthorized printing of said transparency whereby upon removal of said tab means, access to said transparency is allowed without any damage to said transparency.

2. A transparency mount as defined in claim 1 wherein said peripheral adhesive means comprises a plurality of strips of double-sided adhesive tape with one side adhered to said mount and the exposed side of said tape sealed with a peel-off strip which is removed when sealing of a transparency therein is desired.

3. A transparency mount as defined in claim 1 wherein said adhesive means is an adhesive which is applied by the end user in preparation for mounting a transparency therein.

4. A transparency mount as defined in claim 1 wherein said removable tab means comprises a single tab having a first tear zone which extends substantially the full length of said tab and an oppositely disposed, upper and lower tear zone with an intermediate portion having an edge which coincides with one side of said image viewing window.

5. A transparency mount as defined in claim 1 wherein said removable tab means comprises a plurality of tabs each of which has an outer peripheral portion forming a portion of said image viewing window.

6. A tamperproof transparency mount comprising:

a preformed blank having a predetermined length and width and a centrally located fold line dividing said preformed blank into a front and rear portion;

image viewing window means located in each of said front and rear portions;

removable tab means formed in one of said two portions;

adhesive means for sealing said two portions after a transparency has been positioned in one of said front and rear portions whereby folding said preformed blank along said centrally located fold line results in said image viewing windows becoming superimposed with said transparency sealed therein and removal of said tab means allows damage free access to said transparency under authorized conditions.

7. A tamperproof transparency mount as defined in claim 6 wherein said image viewing means comprises a single image viewing window in each of said front and rear portions which provides a single image viewing window when said preformed blank is folded along said fold line.

8. A tamperproof transparency mount as defined in claim 6 wherein said image viewing means comprises a plurality of image viewing windows in each of said front and rear portions which provides a plurality of image viewing windows when said preformed blank is folded along said fold line.

9. A tamperproof transparency mount as defined in claim 6 wherein said removable tab means comprises a single tab having a first preformed tear zone which extends substantially the full length of said tab and a second preformed tear zone formed at the upper and lower portions of said tab means with an intermediate portion between said upper and lower portions of said tab forming a peripheral edge portion of said image viewing window.

10. A tamperproof transparency mount as defined in claim 6 wherein said removable tab means comprises a plurality of tabs having a first preformed tab zone which extends substantially the full length of said plurality of tabs and a second oppositely disposed tear zone formed at the upper and lower portions of said plurality of tabs with an intermediate portion forming a peripheral edge portion of said image viewing window.

11. A tamperproof transparency mount as defined in claim 6 wherein said adhesive means for sealing said transparency within said mount comprises a plurality of strips of double stick tape which are applied by the end user.

12. A tamperproof transparency mount as defined in claim 6 wherein said adhesive means for sealing said transparency within said mount comprises an adhesive which is applied by the end user after inserting the transparency in said image viewing window.

13. A tamperproof transparency mount comprising:

a preformed mount blank having predetermined dimensions; said preformed blank further including a plurality of image viewing windows and a fold line which divides said preformed blank into two equal portions;

adhesive means for sealing the peripheral edges of said preformed blank when folded along said fold line;

protected transparency means positioned within said image viewing window prior to folding and sealing of said peripheral edges;

removable tab means on one of said equal portions for allowing damage free access to said protected transparency means under authorized conditions.

14. A tamperproof transparency mount as defined in claim 13 wherein said adhesive means for sealing said protected transparency means within said mount comprises a plurality of strips of double-sided tape which are applied by the end user after insertion of said protected transparency means.

15. A tamperproof transparency mount as defined in claim 14 wherein said protected transparency means is a transparency positioned within a protective sleeve having indicia thereon to prevent the making of a print while positioned in said protective sleeve.

16. A tamperproof transparency mount as defined in claim 15 wherein said removable tab means comprises a single tear strip having a first tear zone and a second oppositely disposed tear zone separated by an aligned edge which forms a portion of said image viewing window.

17. A tamperproof transparency mount as defined in claim 15 wherein said removable tab means comprises a plurality of tear strips having a first tear zone and a pair of second oppositely disposed tear zone portions, each of which has an edge defining a portion of said image viewing window.

18. A tamperproof transparency mount as defined in claim 15 wherein said removable tab means comprises a plurality of tear strips with each tear strip forming a different edge of said image viewing window.

19. A tamperproof transparency mount as defined in claim 13 wherein said plurality of image viewing windows comprises four image viewing windows on said transparency mount blank, which when folded along said fold line provides two distinct images viewing windows for two transparencies.

* * * * *